US005366855A

United States Patent [19]

Anderson et al.

[11] Patent Number: 5,366,855

[45] Date of Patent: Nov. 22, 1994

[54] PHOTOGRAPHIC SUPPORT COMPRISING AN ANTISTATIC LAYER AND A PROTECTIVE OVERCOAT

[75] Inventors: Charles C. Anderson; Yongcai Wang, both of Penfield, N.Y.

[73] Assignee: Eastman Kodak Company, Rochester, N.Y.

[21] Appl. No.: 221,719

[22] Filed: Mar. 31, 1994

[51] Int. Cl.[5] ..... G03C 1/85

[52] U.S. Cl. ..... 430/530; 430/271; 430/523; 430/527; 430/961

[58] Field of Search ..... 430/523, 271, 527, 530, 430/531, 950, 961

[56] References Cited

U.S. PATENT DOCUMENTS

| | | |
|---|---|---|
| 3,018,272 | 1/1962 | Griffing et al. . |
| 3,929,489 | 12/1975 | Arcesi et al. . |
| 4,069,186 | 1/1978 | Ramig . |
| 4,134,872 | 1/1979 | Lee . |
| 4,203,769 | 5/1980 | Guestaux . |
| 4,307,174 | 12/1981 | Noonan et al. . |
| 4,394,442 | 7/1983 | Miller . |
| 4,419,437 | 12/1983 | Noonan et al. . |
| 4,478,907 | 10/1984 | Van Gossum et al. . |
| 4,478,974 | 10/1984 | Lee et al. . |
| 4,497,917 | 2/1985 | Upson et al. . |
| 4,510,204 | 4/1985 | Duke et al. . |
| 4,543,386 | 9/1985 | Padget et al. . |
| 4,543,387 | 9/1985 | Padget et al. . |
| 4,567,099 | 1/1986 | Van Gilder et al. . |
| 4,612,279 | 9/1986 | Steklenski et al. . |
| 4,613,633 | 9/1986 | Sekiya et al. . |
| 4,683,269 | 7/1987 | Aksman . |
| 4,704,309 | 11/1987 | Coney et al. . |
| 4,735,976 | 4/1988 | Steklenski et al. . |
| 4,738,785 | 4/1988 | Langston et al. . |
| 4,826,907 | 5/1989 | Murso et al. . |
| 4,847,316 | 7/1989 | Schick et al. . |
| 4,880,867 | 11/1989 | Gobel et al. . |
| 4,883,706 | 11/1989 | Grosjean . |
| 4,883,714 | 11/1989 | Stockl et al. . |
| 4,954,559 | 9/1990 | Den Hartog et al. . |
| 5,006,413 | 4/1991 | Den Hartog et al. . |
| 5,006,451 | 4/1991 | Anderson et al. . |

FOREIGN PATENT DOCUMENTS

| | | |
|---|---|---|
| 0466409A1 | 7/1991 | European Pat. Off. . |

*Primary Examiner*—Jack P. Brammer
*Attorney, Agent, or Firm*—Robert A. Gerlach

[57] ABSTRACT

An imaging element comprising a support, a light-sensitive layer and an antistat layer, the antistat layer being overcoated with a protective layer of a coalesced layer of film-forming colloidal polymeric particles and non-film-forming colloidal polymeric particles.

15 Claims, No Drawings

PHOTOGRAPHIC SUPPORT COMPRISING AN ANTISTATIC LAYER AND A PROTECTIVE OVERCOAT

FIELD OF THE INVENTION

This invention relates to photographic support materials having a layer which provides protection against the generation of static charges and a protective layer which overlies the antistatic layer.

BACKGROUND OF THE INVENTION

The need to provide photographic film and paper with antistatic protection is well recognized in the photographic industry. Such protection is important since the accumulation of static charges as a result of various factors in the manufacture, finishing, and use of photographic elements is a serious problem. Accumulation of static charges can result in fog patterns in photographic emulsions, various coating imperfections such as mottle patterns and repellency spots, dirt and dust attraction which may result in the formation of "pinholes" in processed films, and a variety of handling and conveyance problems.

To overcome the problem of accumulation of static charges, it is conventional practice to provide an antistatic layer (i.e., a conductive layer) in photographic elements. A very wide variety of antistatic layers are known for use in photographic elements. For example, an antistatic layer comprising an alkali metal salt of a copolymer of styrene and styrylundecanoic acid is disclosed in U.S. Pat. No. 3,033,679. Photographic films having a metal halide, such as sodium chloride or potassium chloride, as the conducting material, in a hardened polyvinyl alcohol binder are described in U.S. Pat. No. 3,437,484. In U.S. Pat. No. 3,525,621, the antistatic layer is comprised of colloidal silica and an organic antistatic agent, such as an alkali metal salt of an alkylaryl polyether sulfonate, an alkali metal salt of an arylsulfonic acid, or an alkali metal salt of a polymeric carboxylic acid. An antistatic layer comprised of an anionic film forming polyelectrolyte, colloidal silica and a polyalkylene oxide is disclosed in U.S. Pat. No. 3,630,740. In U.S. Pat. No. 3,681,070, an antistatic layer is described in which the antistatic agent is a copolymer of styrene and styrene sulfonic acid. U.S. Pat. No. 4,542,095 describes antistatic compositions comprising a binder, a nonionic surface-active polymer having polymerized alkylene oxide monomers and an alkali metal salt. In U.S. Pat. No. 4,916,011, an antistatic layer comprising a styrene sulfonate-maleic acid copolymer, a latex binder, and an alkyl-substituted trifunctional aziridine crosslinking agent are disclosed. An antistatic layer comprising a vanadium pentoxide colloidal gel is described in U.S. Pat. No. 4,203,769. U.S. Pat. Nos. 4,237,194; 4,308,332; and 4,526,706 described antistats based on polyaniline salt-containing layers. Crosslinked vinylbenzyl quaternary ammonium polymer antistatic layers are described in U.S. Pat. No. 4,070,189.

Frequently, the chemicals in a photographic processing solution are capable of reacting with or solubilizing the conductive compounds in an antistatic layer, thus deleteriously affecting, by causing a diminution or complete loss of the desired antistatic properties. To overcome this problem, antistatic layers are often overcoated with a protective layer to chemically isolate the antistatic layer. In the case of backside (that is, the side opposite to the photographic emulsion layer), the protective layer for the antistatic layer may also serve to provide scratch and abrasion resistance. Typically, this protective layer is a glassy polymer with a glass transition temperature (Tg) of 70° C. or higher that is applied from organic solvent-based coating solutions. For example, in the aforementioned U.S. Pat. No. 4,203,769 the vanadium pentoxide antistatic layer may be overcoated with a cellulosic protective layer applied from an organic solvent. U.S. Pat. Nos. 4,612,279 and 4,735,976 described organic solvent-applied protective overcoats for antistatic layers comprising a blend of cellulosic nitrate and a copolymer containing acrylic acid or methacrylic acid.

Due to environmental considerations, it is desirable to replace organic solvent-based coating formulations with water-based coatings that provide comparable physical and chemical properties in the dried film that can be obtained with organic solvent-based coatings. Aqueous-based backing layers and barrier layers for antistatic coatings have been described. For example, in Anderson, et al., U.S. Pat. No. 5,006,451, issued Apr. 9, 1991, it is disclosed that the use of a latex polymer barrier layer applied over a vanadium pentoxide antistatic subbing layer prevents the loss of antistatic properties after film processing. However, to adequately coalesce the latex (so as to provide an effective barrier layer) during the extremely short drying times typical of high speed film support manufacturing may require the use of significant concentrations of high boiling point organic solvents, "coalescing aids", in the coating formulation. Such coalescing aids may be partially volatilized when the barrier coating is dried and may subsequently recondense in cooler areas of the coating machine. This condensation of high boiling organic compounds can result in a variety of problems such as conveyance problems and various coating imperfections. Coalescing aids that remain permanently in a dried film may have an adverse effect on the physical properties of the layer.

Coatings for photographic applications must also provide required physical and chemical properties such as abrasion resistance and impermeability to aqueous film processing solutions using extremely thin layers. Typically these layers are less than 1 micron thick. Thus, film formation and film quality are especially critical. In addition, coating compositions for photographic film applications must not adversely affect any sensitometric responses (such as cause fogging of the photographic emulsion) or reduce the transparency of the processed film.

SUMMARY OF THE INVENTION

The invention provides an imaging element comprising a support having disposed thereon an antistat layer and an overlying protective layer of a coalesced layer of film-forming colloidal polymeric particles and non-film-forming colloidal polymeric particles.

The protective layer is coated from an aqueous composition comprising a mixture of film-forming, water dispersible polymeric particles and non-film-forming, water dispersible polymeric particles. The mixture of polymers with different film-forming characteristics yields an overcoat composition that readily forms a high quality, continuous transparent film that prevents the loss of antistatic properties during film processing and provides scratch and abrasion resistance.

DETAILED DESCRIPTION OF THE INVENTION

More particularly, the invention relates to a photographic element comprising a support, at least one light-sensitive layer, an antistat layer, and a protective overcoat of a coalesced film of film-forming polymeric particles and non-film-forming polymeric particles. The support material may comprise various polymeric films, such as, cellulose esters including cellulose diacetate, cellulose triacetate, cellulose acetate butyrate, cellulose propionate, paper, glass, and the like, polyester support such as polyethylene terephthalate, polyethylene naphthalate, polycarbonate, polystyrene, polyacrylates, polyolefins, such as, polyethylene polypropylene, etc. Polyesters are preferred. The thickness of the support is not critical. Support thicknesses of 50 μm to 254 μm (2 to 10 mil) can be employed, for example, with very satisfactory results. The polyester support typically employs an undercoat or primer layer between the antistatic layer and the polyester support. Such undercoat layers are well known in the art and comprise, for example, a vinylidene chloride/methyl acrylate/itaconic acid terpolymer or vinylidene chloride/acrylonitrile/acrylic acid terpolymer as described in U.S. Pat. Nos. 2,627,088; 2,698,235; 2,698,240; 2,943,937; 3,143,421; 3,201,249; 3,271,178; and 3,501,301. The antistat layer may be disposed at any relative position in the photographic element including either the emulsion side or backside of the support.

The protective overcoats of the present invention may be successfully employed with a variety of antistatic layers well known in the art. Particularly useful antistatic layers include those described in aforementioned U.S. Pat. Nos. 4,070,189; 4,203,769; 4,237,194; 4,308,332; and 4,526,706, for example, which are incorporated herein by reference.

The antistatic layer described in U.S. Pat. No. 4,203,769 is prepared by coating an aqueous colloidal solution of vanadium pentoxide. Preferably, the vanadium pentoxide is doped with silver. A polymer binder, such as vinylidene chloride-containing terpolymer latex or a polyesterionomer dispersion, is preferably employed in the antistatic layer to improve the integrity of the layer and to improve adhesion to the undercoat layer. The weight ratio of polymer binder to vanadium pentoxide can range from about 1:5 to 200:1, but, preferably 1:1 to 10:1. The antistatic coating formulation may also contain a wetting aid to improve coatability. Typically, the antistat layer is coated at a dry coverage of from about 1 to 200 mg/m$^2$.

Antistatic layers described in U.S. Pat. No. 4,070,189 comprise a crosslinked vinylbenzene quaternary ammonium polymer in combination with a hydrophobic binder wherein the weight ratio of binder to antistatic crosslinked polymer is about 10:1 to 1:1.

The antistatic compositions described in U.S. Pat. Nos. 4,237,194; 4,308,332; and 4,526,706 comprise a coalesced, cationically stabilized latex and a polyaniline acid addition salt semiconductor wherein the latex and semiconductor are chosen so that the semiconductor is associated with the latex before coalescing. Particularly preferred latex binders include cationically stabilized, coalesced, substantially linear, polyurethanes. The weight ratio of polymer latex particles to polyaniline in the antistatic coating composition can vary over a wide range. A useful range of this weight ratio is about 1:1 to 20:1. Typically, the dried coating weight of this antistatic layer is about 40 mg/m$^2$ or less.

The coalesced protective layer in accordance with this invention is applied from a coating composition comprising a continuous aqueous phase having dispersed therein a mixture of a film-forming polymer (component A) and a non-film-forming polymer (component B). Component A comprises 20 to 70%, preferably 30 to 50% of the total weight of components A and B. The average particle size of components A and B are 10 to 500 nm, preferably 10 to 200 nm. Other additional compounds that may be included in the protective overcoat or in the coating composition include surfactants, emulsifiers, coating aids, matte particles, crosslinking agents, inorganic fillers such as metal oxide particles, pigments, magnetic particles and biocides. The coating composition may also include small amounts of organic solvents, preferably the concentration of organic solvent is less than 1 weight percent of the total coating composition. The percentage of the film-forming and non-film-forming polymer in the coalesced protective layer are the same as that set forth for the coating composition.

Whether colloidal polymeric particles are film-forming or non-film-forming is determined by the following test:

An aqueous coating formulation of 3% by weight of colloidal polymeric particles, free of organic solvent or coalescing aid, is applied to a sheet of polyethylene terephthalate in a wet coverage of 10 ml/m$^2$ and dried for 2 minutes at 75° C. Polymers that form clear, transparent continuous films under these conditions are film-forming, while those that do not form clear, transparent continuous films are non-film-forming, for the purpose of this invention.

The non-film-forming polymer (B) comprises glassy polymers that provide resistance to blocking, ferrotyping, abrasion and scratches. These polymers include addition-type polymers and interpolymers prepared from ethylenically unsaturated monomers such as acrylates including acrylic acid, methacrylates including methacrylic acid, acrylamides and methacrylamides, itaconic acid and its half esters and diesters, styrenes including substituted styrenes, acrylonitrile and methacrylonitrile, vinyl acetates, vinyl ethers, vinyl and vinylidene halides, and olefins. In addition, crosslinking and graft-linking monomers such as 1,4-butyleneglycol methacrylate, trimethylolpropane triacrylate, allyl methacrylate, diallyl phthalate, divinyl benzene, and the like may be used. Other polymers that may comprise component B include water-dispersible condensation polymers such as polyesters, polyurethanes, polyamides, and epoxies. Polymers suitable for component B do not give transparent, continuous films upon drying when the above-described test is applied.

The film-forming polymer (A) comprises polymers that form a continuous film under the extremely fast drying conditions typical of the photographic film manufacturing process. Polymers that are suitable for component A are those that give transparent, continuous films when the above-described test is applied and include addition-type polymers and interpolymers prepared from ethylenically unsaturated monomers such as acrylates including acrylic acid, methacrylates including methacrylic acid, acrylamides and methacrylamides, itaconic acid and its half esters and diesters, styrenes including substituted styrenes, acrylonitrile and methacrylonitrile, vinyl acetates, vinyl ethers, vinyl and vinylidene halides, and olefins. In addition, crosslinking and graft-linking monomers such as 1,4-butyleneglycol methacrylate, trimethylolpropane triacrylate, allyl methacrylate, diallyl phthalate, divinyl benzene, and the like may be used. Other suitable polymers useful as component A are film-forming dispersions of polyurethanes or polyesterionomers.

The colloidal polymeric particles can be prepared either by emulsion polymerization or by emulsifying pre-formed polymers in water with a proper dispersing agent. In both cases, chain transfer agents including mercaptans, polymercaptans, and halogen compounds can be used in the polymerization mixture to moderate the polymer molecular weight. The weight average molecular weight of prepared polymers may vary from 5,000 to 30,000,000 and preferably from 50,000 to 10,000,000.

Preparation of polyurethane dispersions is well-known in the art and involves chain extending an aqueous dispersion of a prepolymer containing terminal isocyanate groups by reaction with a diamine or diol. The prepolymer is prepared by reacting a polyester, polyether, polycarbonate, or polyacrylate having terminal hydroxyl groups with excess polyfunctional isocyanate. This product is then treated with a compound that has functional groups that are reactive with an isocyanate, for example, hydroxyl groups, and a group that is capable of forming an anion, typically this is a carboxylic acid group. The anionic groups are then neutralized with a tertiary amine to form the aqueous prepolymer dispersion.

The term polyesterionomer refers to polyesters that contain at least one ionic moiety. Such ionic moieties function to make the polymer water dispersible. These polyesters are prepared by reacting one or more dicarboxylic acids or their functional equivalents such as anhydrides, diesters, or diacid halides with one or more diols in melt phase polycondensation techniques as described in U.S. Pat. Nos. 3,018,272; 3,929,489; 4,307,174; 4,419,437, incorporated herein by reference. Examples of this class of polymers include, for example, Eastman AQ polyesterionomers, manufactured by Eastman Chemical Co.

Typically the ionic moiety is provided by some of the dicarboxylic acid repeat units, the remainder of the dicarboxylic acid repeat units are nonionic in nature. Such ionic moieties can be anionic or cationic, but, anionic moieties are preferred for the present invention. Preferably, the ionic dicarboxylic acid contains a sulfonic acid group or its metal salt. Examples include the sodium, lithium, or potassium salt of sulfoterephthalic acid, sulfonaphthalene dicarboxylic acid, sulfophthalic acid, and sulfoisophthalic acid or their functional equivalent anhydride, diester, or diacid halide. Most preferably the ionic dicarboxylic acid repeat unit is provided by 5-sodiosulfoisophthalic acid or dimethyl 5-sodiosulfoisophthalate.

The nonionic dicarboxylic acid repeat units are provided by dicarboxylic acids or their functional equivalents represented by the formula:

$$-\overset{O}{\overset{\|}{C}}-R-\overset{O}{\overset{\|}{C}}-$$

where R is an aromatic or aliphatic hydrocarbon or contains both aromatic and aliphatic hydrocarbons. Exemplary compounds include isophthalic acid, terephthalic acid, succinic acid, adipic acid, and others.

Suitable diols are represented by the formula: HO—R—OH, where R is aromatic or aliphatic or contains both aromatic and aliphatic hydrocarbons. Preferably the diol includes one or more of the following: ethylene glycol, diethylene glycol, or 1,4-cyclohexanedimethanol.

The polyesterionomer dispersions comprise from about 1 to about 25 mol %, based on the total moles of dicarboxylic acid repeat units, of the ionic dicarboxylic acid repeat units. The polyesterionomers have a glass transition temperature (Tg) of about 60° C. or less to allow the formation of a continuous film.

The film-forming polymeric particles, the non-film-forming polymeric particles or both type particles may include reactive functional groups capable of forming covalent bonds by intermolecular crosslinking or by reaction with a crosslinking agent (i.e., a hardener). Suitable reactive functional groups include: hydroxyl, carboxyl, carbodiimide, epoxide, aziridine, vinyl sulfone, sulfinic acid, active methylene, amino, amide, allyl, and the like.

The coating compositions in accordance with the invention may also contain suitable crosslinking agents that may effectively be used in the coating compositions of the invention including aldehydes, epoxy compounds, polyfunctional aziridines, vinyl sulfones, methoxyalkyl melamines, triazines, polyisocyanates, dioxane drivatives such as dihydroxydioxane, carbodiimides, chrome alum, and zirconium sulfate, and the like. The crosslinking agents may react with functional groups present on either the film-forming polymers, the non-film-forming polymers or on both.

Matte particles well known in the art may be used in the coating composition of the invention, such matting agents have been described in Research Disclosure No. 308, published Dec. 1989, pages 1008 to 1009. When polymeric matte particles are employed, the polymers may contain reactive functional groups capable of forming covalent bonds by intermolecular crosslinking or by reaction with a crosslinking agent (i.e., a hardener) in order to promote improved adherence to the film-forming and non-film-forming polymers of the invention. Suitable reactive functional groups include: hydroxyl, carboxyl, carbodiimide, epoxide, aziridine, vinyl sulfone, sulfinic acid, active methylene, amino, amide, allyl, and the like.

The coating compositions of the present invention may also include lubricants or combinations of lubricants to reduce sliding friction of the photographic elements in accordance with the invention. Virtually any type of water soluble or dispersible lubricants can be used. For example, (1) water soluble or dispersible paraffin or wax-like materials, including vegetable waxes, insect waxes, mineral waxes, petroleum waxes, synthetic waxes, carnauba wax, as well as wax-like components that occur individually in these waxes, (2) perfluoro- or fluoro- or fluorochloro-containing materials, which include poly(tetrafluoroethylene), poly(trifluorochloroethylene), poly(vinylidene fluoride), poly(trifluorochloroethylene-co-vinyl chloride), poly(meth)acrylates containing fluoro or perfluoroalkyl side groups, and the like, (3) poly(meth)acrylates or poly(meth)acrylamides containing long alkyl side groups, (4) silicone lubricants including siloxane containing various (cyclo)alkyl, aryl, epoxypropylalkyl, polyoxyethylene, and polyoxypropylene side groups, and the like.

The above lubricants also may contain reactive functional groups such as hydroxyl, carboxyl, carbodiimide, epoxide, aziridine, vinyl sulfone, sulfinic acid, active methylene, amino, and amide. The amount of lubricants can be incorporated in the coating composition in an amount from 0.1 to 150 mg/m$^2$, preferably from 0.1 to 90 mg/m$^2$.

Any of the reactive functional groups of the polymers and any of the crosslinking agents described in U.S. Pat. No. 5,057,407 and the patents cited therein may be used in accordance with this invention.

The overcoat compositions of the present invention may be applied as aqueous coating formulations containing up to about 50% total solids by coating methods well known in the art. For example, hopper coating, gravure coating, skim pan/air knife coating, spray coating, and other methods may be used with very satisfactory results. The coatings are dried at temperatures up to 150° C. to give dried coating weights of about 100 mg/m$^2$ to 10 g/m$^2$.

The following examples are presented to illustrate the practice of the present invention. The polymeric particles used in the example coatings are listed in Table 1. The film-forming characteristic of each polymer was defined by the test set forth above.

TABLE 1

| Polymer | Polymer Composition | Tg. °C. | Description |
|---|---|---|---|
| P-1 | Methyl methacrylate homopolymer | 125 | Non-film-forming |
| P-2 | Methyl methacrylate/methacrylic acid 97/3 | 130 | Non-film-forming |
| P-3 | Methacrylonitrile homopolymer | 115 | Non-film-forming |
| P-4 | Methacrylonitrile/methacrylic acid 97/3 | 115 | Non-film-forming |
| P-5 | Styrene/methacrylic acid 97/3 | 115 | Non-film-forming |
| P-6 | Butyl acrylate/methyl methacrylate/acrylic acid 48.5/48.5/3 | 20 | Film-forming |
| P-7 | ICI Neorez 960 polyurethane dispersion | 10 | Film-Forming |
| P-8 | Eastman Chemical Co. AQ29D polyesterionomer dispersion | 29 | Film-forming |
| P-9 | Eastman Chemical Co. AQ55D polyesterionomer dispersion | 55 | Film-forming |

COMPARATIVE SAMPLES A–C AND EXAMPLES 1–15

A polyester film support subbed with a terpolymer latex of acrylonitrile, vinylidene chloride, and acrylic acid was coated with an aqueous antistatic formulation comprising 0.025 weight % of silver-doped vanadium pentoxide, 0.075 weight % of a terpolymer latex of methylacrylate, vinylidene chloride,and itaconic acid (15/83/2) and dried at 100° C. to yield an antistatic layer having a dry weight of about 8 mg/m$^2$. Aqueous coating compositions of the invention containing 1 to 3 weight % solids were applied over the antistatic layer and dried for 90 seconds at 100° C. to yield transparent coatings having a dry weight of 250 to 750 mg/m$^2$. It is known (described in U.S. Pat. Nos. 5,006,451 and 5,221,598) that the antistatic properties of the vanadium pentoxide layer are destroyed after film processing if not protected by an impermeable barrier. Thus, the permeability of the example coatings are evaluated by measuring the antistatic properties of the samples after processing in conventional film developing and fixing solutions.

The samples were soaked in high pH (11.3) developing and fixing solutions as described in U.S. Pat. No. 4,269,929, at 38° C. for 60 seconds each and then rinsed in distilled water. The internal resistivity (using the salt bridge method) of the processed samples at 20% relative humidity was measured and compared with the internal resistivity before processing. The coating compositions and results are reported in Table 2. Excellent results were obtained for Examples 1–15. The permanency of the antistatic properties for the coatings of the invention are comparable to those obtained for sample A which is an organic solvent applied protective overcoat comprising Elvacite 2041 (a methyl methacrylate polymer sold by E. I. Du Pont de Nemours and Co.) and are far superior to those for an aqueous protective overcoat composition comprising only the high Tg methyl methacrylate copolymer dispersion alone (sample B).

TABLE 2

| Coating | Description | Coating Weight (mg/m$^2$) | Resistivity Before Process log Ω/sq. | Resistivity After Process log Ω/sq. |
|---|---|---|---|---|
| Sample A | Solvent Coated Elvacite 2041 | 750 | 7.5 | 7.7 |
| Sample B | P-2 without film-forming polymer | 750 | 7.5 | >14.0 |
| Sample C | P-7 without non-film-forming polymer | 750 | 9.3 | 10.3 |
| Example 1 | P-1/P-6 70/30 ratio | 750 | 8.1 | 8.2 |
| Example 2 | P-2/P-8 70/30 ratio | 750 | 7.9 | 8.3 |
| Example 3 | P-2/P-9 70/30 ratio | 750 | 8.0 | 8.1 |
| Example 4 | P-2/P-7 70/30 ratio | 750 | 8.0 | 8.9 |
| Example 5 | P-2/P-7 70/30 ratio, with aziridine* | 750 | 7.6 | 7.6 |
| Example 6 | P-2/P-6 70/30 ratio, with aziridine* | 750 | 7.6 | 7.6 |
| Example 7 | P-5/P-7 70/30 ratio | 750 | 7.6 | 7.7 |
| Example 8 | P-5/P-9 70/30 ratio | 750 | 7.6 | 7.8 |
| Example 9 | P-3/P-7 70/30 ratio | 750 | 8.0 | 8.0 |
| Example 10 | P-4/P-7 70/30 ratio, with aziridine* | 750 | 7.8 | 7.9 |
| Example 11 | P-2/P-7 70/30 ratio, with aziridine* | 250 | 8.5 | 8.7 |
| Example 12 | P-2/P-7 70/30 ratio, with aziridine* | 1000 | 7.3 | 7.2 |
| Example 13 | P-2/P-7 70/30 ratio, with aziridine* | 1000 | 7.3 | 7.9 |
| Example 14 | P-2/P-7 70/30 ratio, with aziridine* and polymethylmethacrylate 2 μm matte | 750 | 7.2 | 7.3 |
| Example 15 | P-2/P-7 70/30 ratio, with aziridine* | 750 | 7.4 | 7.5 |

TABLE 2-continued

| Coating | Description | Coating Weight ($mg/m^2$) | Resistivity Before Process log Ω/sq. | Resistivity After Process log Ω/sq. |
|---|---|---|---|---|
| | and polymethylmethacrylate-co-methacrylic acid 2 μm matte | | | |

*-PFAZ ® 322 polyfunctional aziridine, Sybron Chemicals Inc., added at 10 wt % of solids.

EXAMPLES 16–18

Subbed polyester film support was coated with an aqueous antistatic formulation comprising a crosslinked vinylbenzyl quaternary ammonium latex polymer as described in U.S. Pat. No. 4,070,189 and a methyl acrylate/N-(3-aminopropyl)methacrylamide hydrochloride 95/5 copolymer latex binder. The antistatic layer was coated at a dry weight of 200 $mg/m^2$ and contained a 1/1 ratio of the antistatic polymer to binder polymer. Aqueous overcoat formulations were then applied over the antistatic layer and dried as before to give transparent coatings with a dry weight of 750 $mg/m^2$. The samples were then evaluated for antistatic properties (at 50% RH) after film processing in an analogous manner to that described in Examples 1–15, the results are given in Table 3.

TABLE 3

| Coating | Description | Coating Appearance | Resistivity Before Process log Ω/sq. 50% RH | Resistivity After Process log Ω/sq. 50% RH |
|---|---|---|---|---|
| Example 16 | P-2/P-7 70/30 ratio | Slight Haze | 8.6 | 9.2 |
| Example 17 | P-2/P-7 70/30 ratio, with aziridine* | Good | 8.7 | 8.7 |
| Example 18 | P-2**/P-7 70/30 ratio, with aziridine* | Excellent | 9.0 | 9.0 |

**-P-2 latex was dialyzed in a cellulosic membrane prior to use.
*-PFAZ ® 322 polyfunctional aziridine, Sybron Chemicals Inc., added at 10 wt % solids.

COMPARATIVE SAMPLES E AND F AND EXAMPLES 19–24

The following examples demonstrate the excellent physical properties that are obtained for antistatic backing layers of the invention. Antistatic coatings comprising vanadium pentoxide were applied onto a moving web of subbed polyester film support and dried at 105° C. to give a dried coating weight for the antistatic layer of 8 $mg/m^2$. Aqueous protective overcoat formulations were then coated over the antistatic formulation to give transparent films with a dry coating weight of 750 $mg/m^2$, these coatings also comprised 5 $mg/m^2$ of a 3.5 micron diameter polymethyl methacrylate matte. Single arm scratch and Taber abrasion for these coatings were measured and compared with a 750 $mg/m^2$ coating of Elvacite 2041 that had been coated from methylene chloride solution onto the vanadium pentoxide antistatic layer. The single arm scratch and Taber abrasion tests were performed in accordance with the procedures set forth in ANSI PH 1.37-1977 and ASTM D1044, respectively. The results are given in Table 4.

TABLE 4

| Coating | Description | Taber Abr. (% haze) | Single Arm Scratch (gms) |
|---|---|---|---|
| Sample E | Solvent coated Elvacite 2041 | 7.0 | 30 |
| Sample F | P-7 | 13.5 | 60 |
| Example 19 | P-2/P-7 70/30 ratio | 7.0 | 60 |
| Example 20 | P-2/P-7 70/30 ratio, with aziridine* | 7.0 | 70 |
| Example 21 | P-2/P-7 72.5/27.5 ratio, with aziridine* | 7.0 | 60 |
| Example 22 | P-2/P-8 70/30 ratio | 9.8 | — |
| Example 23 | P-2/P-9 70/30 ratio | 11.0 | — |
| Example 24 | P-2/P-9 70/30 ratio, with aziridine* | 8.4 | — |

*-PFAZ ® 322 polyfunctional aziridine, Sybron Chemicals Inc., added at 10 wt % of solids.

EXAMPLES 25–27

The resistance to blocking for the antistatic backings of the invention was evaluated by: coating a vanadium pentoxide antistatic layer and a protective overcoat layer onto a polyester film support as in the previous examples; placing a 4 inch by 4 inch sheet of the sample in contact with a similar size sheet of film with a gelatin coating so that the backing layer of the invention was in contact with the gelatin layer; placing the two sheets of film into a Carver press at 14000 psi pressure and a temperature of 50° C. and 70° C. for 2 minutes. The samples were then taken out of the press and separated to evaluate their blocking resistance. In all cases the coatings separated from the gelatin coated film samples with no effort or very slight effort. The coating compositions and the results are listed in Table 5.

TABLE 5

| Coating | Description | Resistance to Blocking (50° C.) | Resistance to Blocking (70° C.) |
|---|---|---|---|
| Example 25 | P-2/P-8 70/30 ratio | Excellent | Very Good |
| Example 26 | P-2/P-7 70/30 ratio, with aziridine* | Excellent | Very Good |
| Example 27 | P-2/P-7 70/30 ratio, with aziridine* | Excellent | Very Good |

*-PFAZ ® 322 polyfunctional aziridine, Sybron Chemicals Inc., added at 10 wt % of solids.

EXAMPLES 28–30

In addition to testing procedures already described, Paper Clip Friction (PCF) was measured for the following examples using the procedure set forth in ANSI IT 9.4-1992. These examples serve to illustrate the excellent lubricity and scratch resistance that can be obtained with coating compositions of the invention upon incorporation of various lubricant materials. The coatings of the invention were applied over a conductive layer comprising vanadium pentoxide as described in previous examples.

TABLE 6

| Coating | Description | Coating Weight ($mg/m^2$) | Resistivity Before Process log Ω/sq. | Resistivity After Process log Ω/sq. | PCF | Single Arm Scratch (gms) |
|---|---|---|---|---|---|---|
| Example 28 | P-2/P-7 70/30 ratio, with aziridine* Michemlube** 160 at 0.75 $mg/m^2$ | 1000 | 8.2 | 7.6 | 0.20 | — |
| Example 29 | P-2/P-7.5/Teflon 30+ 62/35/3 ratio with aziridine* | 750 | 7.6 | 7.6 | 0.15 | 70 |
| Example 30 | P-2/P-7/Teflon 3170+ 62/35/3 ratio with aziridine* | 750 | 7.8 | 7.9 | 0.125 | 110 |

+ - Teflon 30 and Teflon 3170 aqueous dispersions available from DuPont de Nemours and Co.
**Aqueous carnauba wax dispersion sold by Michelman Inc.
*-PFAZ ® 322 polyfunctional aziridine, Sybron Chemicals Inc., added at 10 wt % of solids.

What is claimed is:

1. An imaging element comprising a support, a light-sensitive layer and an antistatic layer, the antistatic layer being overcoated with a protective layer of a coalesced layer of film-forming colloidal polymeric particles and non-film-forming colloidal polymeric particles.

2. The imaging element of claim 1 wherein the coalesced layer containing 20 to 70 percent by weight of the film forming polymer.

3. The imaging element of claim 2 wherein the film forming polymer is present in the amount of 30 to 50 percent by weight.

4. The imaging element of claim 1 wherein the antistat layer deleteriously affected by the photographic processing solution.

5. The imaging element of claim 4 wherein the antistat layer contains vanadium pentoxide.

6. The imaging element of claim 1 wherein the light-sensitive layer is a silver halide emulsion layer.

7. The imaging element of claim 1 wherein the light-sensitive layer is a thermal imaging layer.

8. The imaging element of claim 1 wherein the polymer of the film-forming colloidal particles is an addition polymer.

9. The imaging element of claim 1 wherein the polymer of the film-forming colloidal particles is a condensation polymer.

10. The imaging element of claim 9 wherein the condensation polymer is a polyurethane or a polyester ionomer.

11. The imaging element of claim 10 wherein the condensation polymer is a polyurethane.

12. The imaging element of claim 10 wherein the condensation polymer is a polyester ionomer.

13. The imaging element of claim 1 wherein the coalesced layer has a coefficient of friction less than 0.25.

14. The imaging element of claim 1 wherein at least a portion of the non-film-forming colloidal polymer particles is a fluoro-containing polymer.

15. The imaging element of claim 1 wherein the film-forming colloidal polymeric particles or the non-film-forming colloidal polymeric particles are crosslinked.

* * * * *